US008998582B2

(12) United States Patent
Wait et al.

(10) Patent No.: US 8,998,582 B2
(45) Date of Patent: Apr. 7, 2015

(54) FLOW VECTOR CONTROL FOR HIGH SPEED CENTRIFUGAL PUMPS

(75) Inventors: Scott R. Wait, Arvada, CO (US); John E. Sidelko, Arvada, CO (US)

(73) Assignee: Sundyne, LLC, Arvada, CO (US)

( * ) Notice: Subject to any disclaimer, the term of this patent is extended or adjusted under 35 U.S.C. 154(b) by 630 days.

(21) Appl. No.: 13/288,126

(22) Filed: Nov. 3, 2011

(65) Prior Publication Data

US 2012/0121421 A1 May 17, 2012

Related U.S. Application Data

(60) Provisional application No. 61/413,831, filed on Nov. 15, 2010.

(51) Int. Cl.

| | |
|---|---|
| ***F03B 3/12*** | (2006.01) |
| ***F04D 29/22*** | (2006.01) |
| ***F04D 29/24*** | (2006.01) |
| ***F04D 29/66*** | (2006.01) |

(52) U.S. Cl.

CPC ..... *F04D 29/2277* (2013.01); *F04D 29/242* (2013.01); *F04D 29/669* (2013.01)

(58) Field of Classification Search

CPC ..... F04D 29/24; F04D 29/242; F04D 29/245; F04D 29/669; F04D 29/2216

USPC ..... 415/199.6; 416/175, 183, 185, 200 R, 416/210 A, 202, 234, 235, 223 B, DIG. 2, 416/186, 224

See application file for complete search history.

(56) References Cited

U.S. PATENT DOCUMENTS

| | | | | |
|---|---|---|---|---|
| 1,097,729 | A | 5/1914 | Rice | |
| 1,169,476 | A | 1/1916 | Gramlich | |
| 1,946,273 | A | 2/1934 | Carr | |
| 2,830,753 | A | 4/1958 | Stalker | |
| 2,839,239 | A | 6/1958 | Stalker | |
| 2,922,374 | A | 1/1960 | Perish | |
| 3,013,501 | A | 12/1961 | Ygge | |
| 3,065,954 | A * | 11/1962 | Whitaker | 416/183 |
| 3,285,187 | A | 11/1966 | Anderson, Jr. | |
| 3,737,249 | A | 6/1973 | Cooper | |
| 3,759,628 | A | 9/1973 | Kempf | |
| 3,953,150 | A | 4/1976 | Onal | |
| 3,972,646 | A | 8/1976 | Brown et al. | |

(Continued)

FOREIGN PATENT DOCUMENTS

| | | | |
|---|---|---|---|
| EP | 1887126 A1 * | 2/2008 | D06F 39/08 |
| GB | 2418571 A | 3/2006 | |
| WO | 0165119 A1 | 9/2001 | |

OTHER PUBLICATIONS

European Search Report for European Application No. 11188711.3 completed on Jul. 16, 2014.

*Primary Examiner* — Dwayne J White
*Assistant Examiner* — Jason Fountain
(74) *Attorney, Agent, or Firm* — Carlson, Gaskey & Olds, PC

(57) ABSTRACT

An impeller for a centrifugal pump includes a radially inner hub, and a plurality of blades extending straight and along a direction that is perpendicular to a rotational axis of the impeller. The blades extend from a radially outer end to a radially inner end, and define a generally frusto-conical envelope. A flow control feature is formed between the radially inner end of the blades and the hub. The flow control feature has a curved upper surface.

1 Claim, 2 Drawing Sheets

(56) References Cited

U.S. PATENT DOCUMENTS

| | | | | |
|---|---|---|---|---|
| 3,989,406 | A | 11/1976 | Bliss | |
| 4,012,172 | A | 3/1977 | Schwaar et al. | |
| 4,080,102 | A | 3/1978 | Schwab | |
| 4,135,858 | A | 1/1979 | Entat | |
| 4,208,169 | A | 6/1980 | Becker et al. | |
| 4,358,246 | A | 11/1982 | Hanson et al. | |
| 4,626,174 | A | 12/1986 | Sato et al. | |
| 4,752,187 | A | 6/1988 | Hergt et al. | |
| 4,795,312 | A | 1/1989 | Purcaru | |
| 5,192,193 | A | 3/1993 | Cooper et al. | |
| 5,470,201 | A | 11/1995 | Gilbert et al. | |
| 5,478,200 | A | 12/1995 | Brodersen et al. | |
| 5,586,863 | A | 12/1996 | Gilbert et al. | |
| 5,597,289 | A | 1/1997 | Thut | |
| 5,634,770 | A | 6/1997 | Gilbert et al. | |
| 6,019,576 | A | 2/2000 | Thut | |
| 6,361,270 | B1 * | 3/2002 | Bennett | 415/57.2 |
| 6,435,829 | B1 | 8/2002 | Meng et al. | |
| 6,457,940 | B1 | 10/2002 | Lehman | |
| 6,905,310 | B2 * | 6/2005 | Kawamoto et al. | 416/175 |
| 8,511,998 | B2 * | 8/2013 | Burgess et al. | 416/185 |
| 2012/0100003 | A1 * | 4/2012 | Masutani | 416/235 |

* cited by examiner

FLOW VECTOR CONTROL FOR HIGH SPEED CENTRIFUGAL PUMPS

RELATED APPLICATION

This application claims priority to U.S. Provisional Application No. 61/413,831, which was filed Nov. 15, 2010.

BACKGROUND OF THE INVENTION

This application relates to an impeller having blades which run perpendicularly to a rotational axis with a feature extending from the blades to a hub.

High speed centrifugal pumps include any number of configurations. One configuration has a plurality of straight blades extending from an outer periphery of an impeller radially inwardly, and perpendicularly to a rotational axis of the impeller. In these pumps, the blades typically end at a location radially spaced from a hub, or inner shroud.

Cavitation can occur at the location between the radially inner end of the blades, and an outer periphery of the hub. Cavitation in high speed centrifugal pumps is difficult to prevent, but has been addressed by modifying an inlet case geometry, or the housing. In addition, an inducer may be provided upstream of the impeller, and serves to direct the pump fluid flow toward the impeller blades. The inducer design may be changed to address cavitation. In addition, the corners of the blades have sometimes been rounded.

The interaction between the straight impeller blades and the flow entering the impeller at a given operating point may create cavitation even with all of the above-referenced attempts. Cavitation is undesirable, and can result in vapor formation, and flow collapse, and can cause damage to the impeller.

SUMMARY OF THE INVENTION

An impeller for a centrifugal pump includes a radially inner hub, and a plurality of blades extending straight and along a direction that is perpendicular to a rotational axis of the impeller. The blades extend from a radially outer end to a radially inner end, and define a generally frusto-conical envelope. A flow control feature is formed between the radially inner end of the blades and the hub. The flow control feature has a curved upper surface.

DETAILED DESCRIPTION

Figure 1:
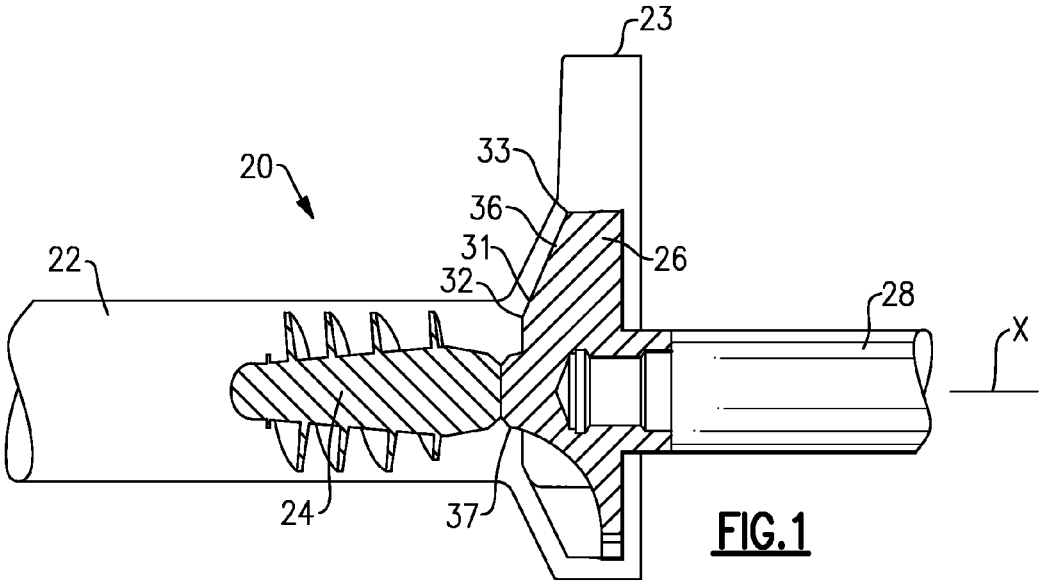
FIG. 1 shows a first impeller embodiment.

FIG. 1 shows a pump 20 having a flow inlet 22 leading into an inducer 24. The inducer directs fluid flow towards the pump impeller 26. An outlet 23 extends downstream of the impeller 26. A shaft 28 drives the impeller 26 to rotate.

Blades 36 have a radially outer end 33 ramping upwardly to a radially inner end 31. As can be appreciated in this cross-section, an axially outer face of the blades 36 defines an envelope which is generally frusto-conical. An anti-cavitation or flow control feature 32 is formed radially inwardly of an inner end 31 of the blades 36, and extending all the way to an inner hub 37. As can be appreciated, an outer diameter of blades on the inducer 24 may be generally smaller than an outer diameter of the features 32.

Figure 2:
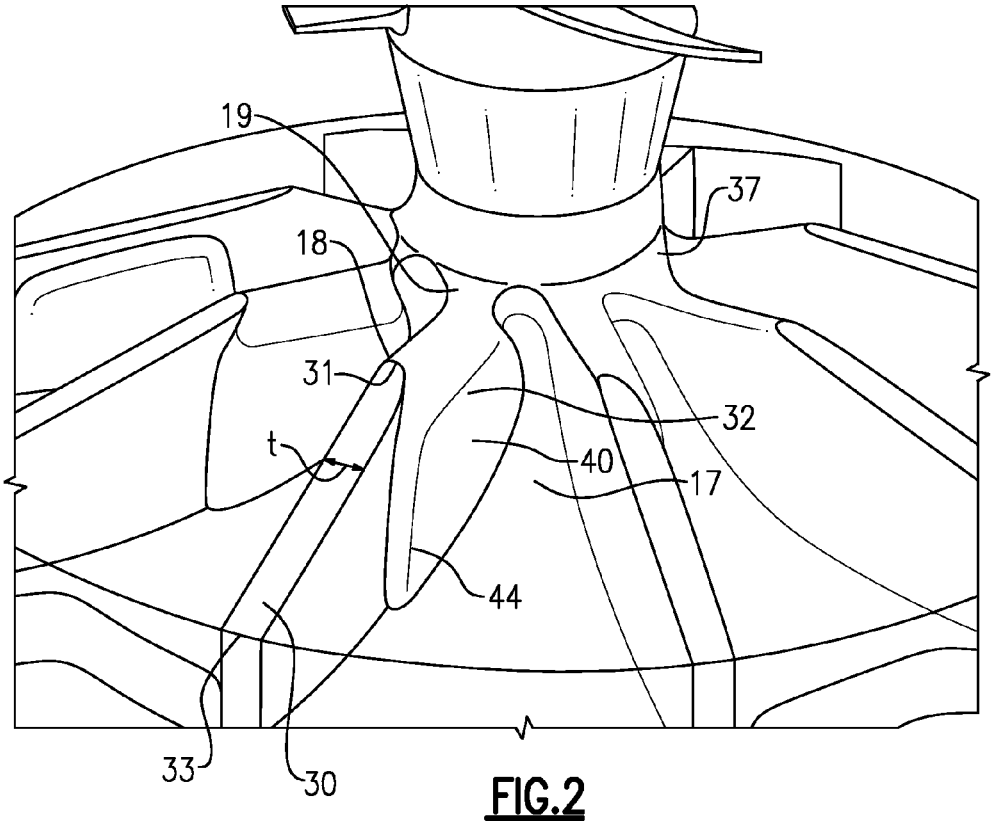
FIG. 2 shows a front view of features of the first embodiment.

As shown in FIG. 2, the blade outer surface 30 is generally conical. In addition, the blade extends directly perpendicularly towards a central rotational axis X of the impeller 26 and shaft 28. The feature 32 extends from its radially outermost edge 18 to merge at 19 into the inner hub 37. The feature 32 has additional material in an enlarged portion 40 that is thicker in a circumferential direction than a thickness t of the blade 36. Thus, there is additional material to one side (the trailing edge) of the feature 32, which provides additional rigidity to the overall impeller 26.

Spaces 17 are formed between the features 32.

As can be appreciated from FIG. 2, the radially outer end 44 of the features 32 may extend radially beyond the radially inner end 31 of the blades 36.

The feature 32 of FIGS. 1 and 2 may be radially tapered, such that it is thinner at a radially outer portion 44 of the enlarged portion 40 than it may be at a radially inner portion.

Figure 3:
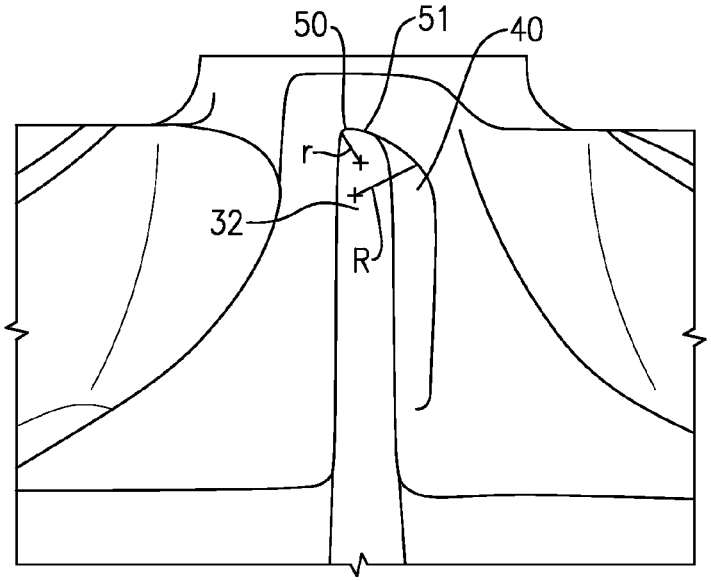
FIG. 3 is a cross-sectional view through a portion of the FIG. 2 embodiment.

FIG. 3 shows that there is a radius of curvature r from the side, or leading edge 50 that merges into a curve 51. Forming a curve 50/51 at the top of feature 32 assists in directing the flow along the feature, and provides the flow will be less likely to deviate from the impeller surface. As shown, the curve 51 is at a radius R. The illustrated radius R in FIG. 3 is deeper into the plane than the cross-section shown. As can be appreciated, the radius R may vary due to the taper. In one embodiment, radius r is very small relative to radius R in order to maximize radius R and thus feature effectiveness for a given blade thickness t. In embodiments, the ratio of radius r to blade thickness t is less than 5. Further, the ratio of t to R will generally be less than 1.

As is clear from FIG. 1, the features 32 have an uppermost surface which is generally extending directly straight into the hub 37, and such that the plurality of uppermost surfaces of the plurality of features 32 would define a plane that is perpendicular to the rotational axis X of the impeller 26. That is, while the features 32 are curved in a tangential direction, as shown, elsewhere they are not curved, but instead extend generally straight along a radially dimension.

The feature 32 acts as a dam to prevent backflow from downstream currents, and further serves to prevent cavitation. The tapering of the additional material of enlarged portion 40 is largest nearest the axis of rotation, and provides more thickness near the axis of rotation.

Figure 4:
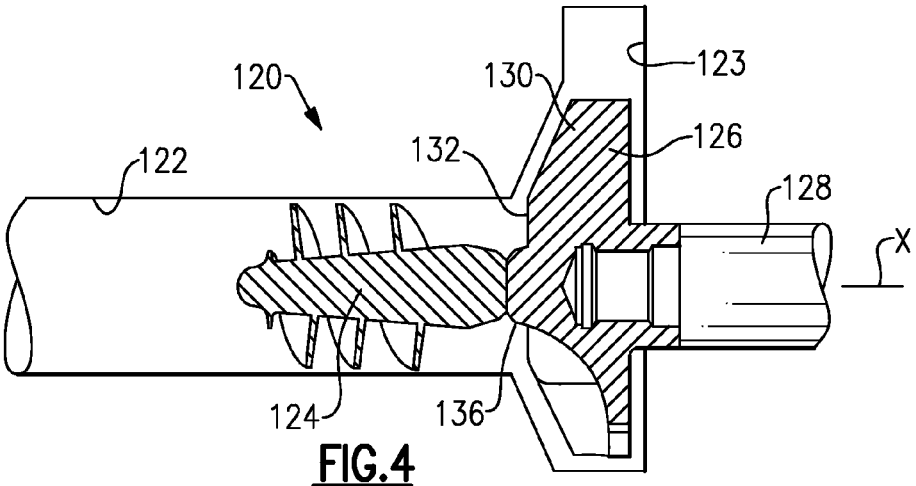
FIG. 4 shows a second embodiment.

FIG. 4 shows another embodiment pump 120 having an impeller 126 driven by a shaft 128, and receiving fluid from an inlet 122. An inducer 124 may also be used with this embodiment. Again, blades 130 ramp upwardly to a radially inner end, and then the feature 132 begins. As can be appreciated, the feature 132 extends to the inner hub 136.

Figure 5:
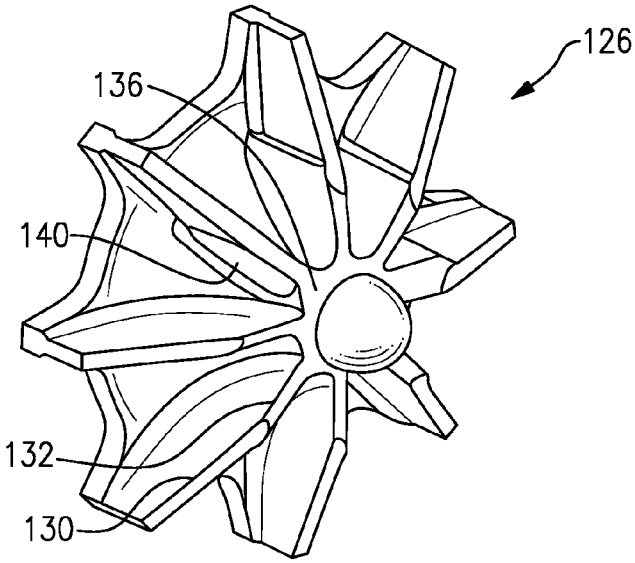
FIG. 5 shows a detail of the second embodiment.

FIG. 5 shows the impeller 126. As can be appreciated, in this embodiment, the additional material 140 does not have the radial taper, and is generally of the same thickness along its entire length. Otherwise, the blades 130 merge into features 132, which merge into hub 136.

While the impeller is shown with an inducer in FIG. 1, it may also be utilized without as shown in FIG. 5. Any number of outlet housings may be utilized. In addition, so-called "splitter vanes" can be utilized with this impeller.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. An impeller for a centrifugal pump including:

a radially inner hub, and a plurality of blades extending straight and along a direction that is perpendicular to a rotational axis of the impeller, said blades extending from a radially outer end to a radially inner end, and defining a generally frusto-conical outer envelope at an axially outer face of the blades;

a flow control feature positioned between the radially inner end of each of said blades and extending to said hub, and said flow control feature having a curved upper surface, an uppermost surface of the flow control feature defines a plane that is perpendicular to the rotational axis of the impeller;

said blades having a generally conical upper surface that merges into said flow control feature;

there is additional material on a trailing edge of the blades and the features, such that the trailing edge additional material adds to the thickness of each of the flow control features;

there are circumferentially spaced spaces between the additional material and a leading edge of the next adjacent flow control feature; and said curved upper surface having at least a first portion formed at a first radius that is greater than a circumferential thickness of said blades, and said curved upper surface also includes a second portion merging from a side wall of said flow control feature into said first portion, with said second portion being at a radius of curvature that is smaller than said first radius of curvature.

* * * * *